United States Patent [19]

Fukuda

[11] Patent Number: 4,758,021

[45] Date of Patent: Jul. 19, 1988

[54] BOOKLET OF FOLDED WEB CONSTRUCTION AND METHOD OF MANUFACTURE

[76] Inventor: Manabu Fukuda, 122, Takano 1-chome, Misato-shi, Saitama-ken, Japan

[21] Appl. No.: 817,437

[22] Filed: Jan. 9, 1986

[30] Foreign Application Priority Data

Jan. 26, 1985 [JP] Japan ..... 60-11792

[51] Int. Cl.[4] ..... B42D 15/00; B42D 1/00

[52] U.S. Cl. ..... 281/15 R; 270/52.5; 281/2

[58] Field of Search ..... 281/2, 5, 15 R, 18; 412/1, 6, 7; 270/53, 40, 39, 52.5, 39; 493/347, 411, 413; 283/45, 46, 49, 50

[56] References Cited

U.S. PATENT DOCUMENTS

| | | | |
|---|---|---|---|
| 1,670,254 | 5/1928 | Gowin | 283/46 |
| 1,884,197 | 10/1932 | Peterson et al. | 283/46 |
| 1,915,653 | 6/1933 | Dutton | 283/46 |
| 2,234,075 | 3/1941 | Carolin | 283/46 |
| 4,118,022 | 10/1978 | Rayfield et al. | 270/52.5 |
| 4,285,531 | 8/1981 | Balsamo | 281/2 |
| 4,508,527 | 4/1985 | Uno et al. | 270/40 |
| 4,573,670 | 3/1986 | Felix | 270/39 |
| 4,575,121 | 3/1986 | Conti | 281/2 |
| 4,611,799 | 9/1986 | Nuttin | 270/52.5 |

*Primary Examiner*—Paul A. Bell

*Attorney, Agent, or Firm*—Bruce L. Adams; Van C. Wilks

[57] ABSTRACT

A booklet suitable for use as a testbook or as a supplement to other printed publications is made from a single continuous web of paper which has printed matter on both sides thereof, and which has been folded alternately in opposite directions along successive perforated lines extending transversely of the web at a constant longitudinal spacing. The folded web is stapled or otherwise held together along a rear binding edge. The thus produced booklet has every two neighboring leaves thereof joined together at their unbound edges opposite the binding edge. Such joined leaves are to be separated by the reader by tearing the same along the row of perforations between at their unbound edges. The top and bottom edges of every two neighboring leaves extending between the binding and unbound edges may further be sealed together in a readily openable manner. In the use of this booklet as a testbook, for example, questions and answers may be printed on the outer and inner pages, respectively, of every two joined leaves.

29 Claims, 3 Drawing Sheets

BOOKLET OF FOLDED WEB CONSTRUCTION AND METHOD OF MANUFACTURE

BACKGROUND OF THE INVENTION

My invention relates to book format in general and, in particular, to a novel construction of a book that may more aptly be classified as a booklet being made from a continuous folded web of paper or like material, and to a method of manufacturing such a booklet. The booklet in accordance with my invention finds optimum use as workbooks, as manuals, or as supplements to other printed publications such as larger books or magazines, although other uses may of course be found within the scope of my invention.

Workbooks or drill books, a typical application of the booklet in accordance with my invention, will serve best to illustrate its utility. Workbooks or test books are in common use among students and pupils which contain both questions or problems to be solved and their answers. With the conventional format of workbooks, or of books or other printed publications in general, the answers have been given either on the same pages as the questions, or on pages following the question pages. Such usual arrangements of questions and answers have a drawback that the student, when unable to solve the questions, is easy to check the answers before fully reconsidering the questions or referring to some pertinent book or the like. He will then learn from the workbook not so much as he would if he endeavored hard enough before checking the printed answers.

The same is true with manuals for the mastery of an art or skill such as, for example, chess. The student of the art or skill will make greater progress by fully studying the problems given in the manual before looking up their solutions.

SUMMARY OF THE INVENTION

I have hereby invented a booklet of novel format which is admirably well suited for use as workbooks or manuals containing both questions or problems to be solved by the reader and their solutions. My invention further comprehends a method of manufacturing the booklet in the simplest and most practical way.

Briefly summarizing one aspect thereof, my invention provides a booklet comprising a continuous web of paper or like material printed on both sides thereof and folded alternately in opposite directions along predetermined folding lines extending transversely of the web at a constant longitudinal spacing. The folds or folded portions of the web are bound together along their rear edges by means such as wire staples. Every two neighboring folds or leaves of the booklet thus produced are joined together along their front edges opposite the bound rear edges. The web has therein a row of perforations along the boundary between every two joined leaves of the booklet at the front edge so that these leaves can be torn open by the reader along the perforated folding line.

According to another aspect of my invention, there is provided a method of manufacturing a booklet of the foregoing construction, which comprises preparing a web which has printed matter on both sides thereof and which has therein rows of perforations extending transversely thereof at a constant longitudinal spacing. The web is folded in zigzag manner along the successive rows of perforations alternately in opposite directions.

Then the folded web is bound along a rear edge thereof to complete the fabrication of the booklet.

Thus, for the manufacture of a workbook in the format of my invention, questions may be printed on one side, and their answers on the other side of the continuous web. This web may then be folded and bound as above described so that the question side of the web forms the outer pages of every two joined leaves of the booklet, and the answer side of the web forms the inner pages of such leaves. As required, every two neighboring leaves may be united together in a readily separable manner by sealing their top and bottom edges in addition to their unbound front edges. The reader can then see only the question pages of the booklet and must tear every two joined pages apart along the perforated line between their front edges and, as necessary, along the sealed regions adjacent their top and bottom edges as well, for referring to the answer pages. There is accordingly a far less likelihood of the reader seeing the printed answers before solving the questions or before giving full thought thereto.

As an additional advantage of my novel format, the answers can be on the page immediately following the page bearing the problems. Therefore, once any two joined leaves are torn open, the student can examine the problems and answers given close to each other.

According to the method of my invention summarized previously, the continuous printed web is folded alternately in opposite directions along the successive perforated lines preformed therein at a constant longitudinal spacing. The folding of the web is therefore easy. In the completed booklet, moreover, those of the perforated lines which are at its front edge serve the additional purpose of ensuring the tearing of every two united leaves. Furthermore, as will be understood by those versed in the bookbinding art, the complete process of booklet manufacture in accordance with my invention can be performed all by streamlined, automatic equipment compising printing, perforating, sealing, folding, and binding sections.

The above and other features and advantages of my invention and the manner of realizing them will become more apparent, and the invention itself will best be understood, from a study of the following description and appended claims, with reference to the attached drawings showing a preferred embodiment of my invention.

DETAILED DESCRIPTION OF THE INVENTION

Figure 1:
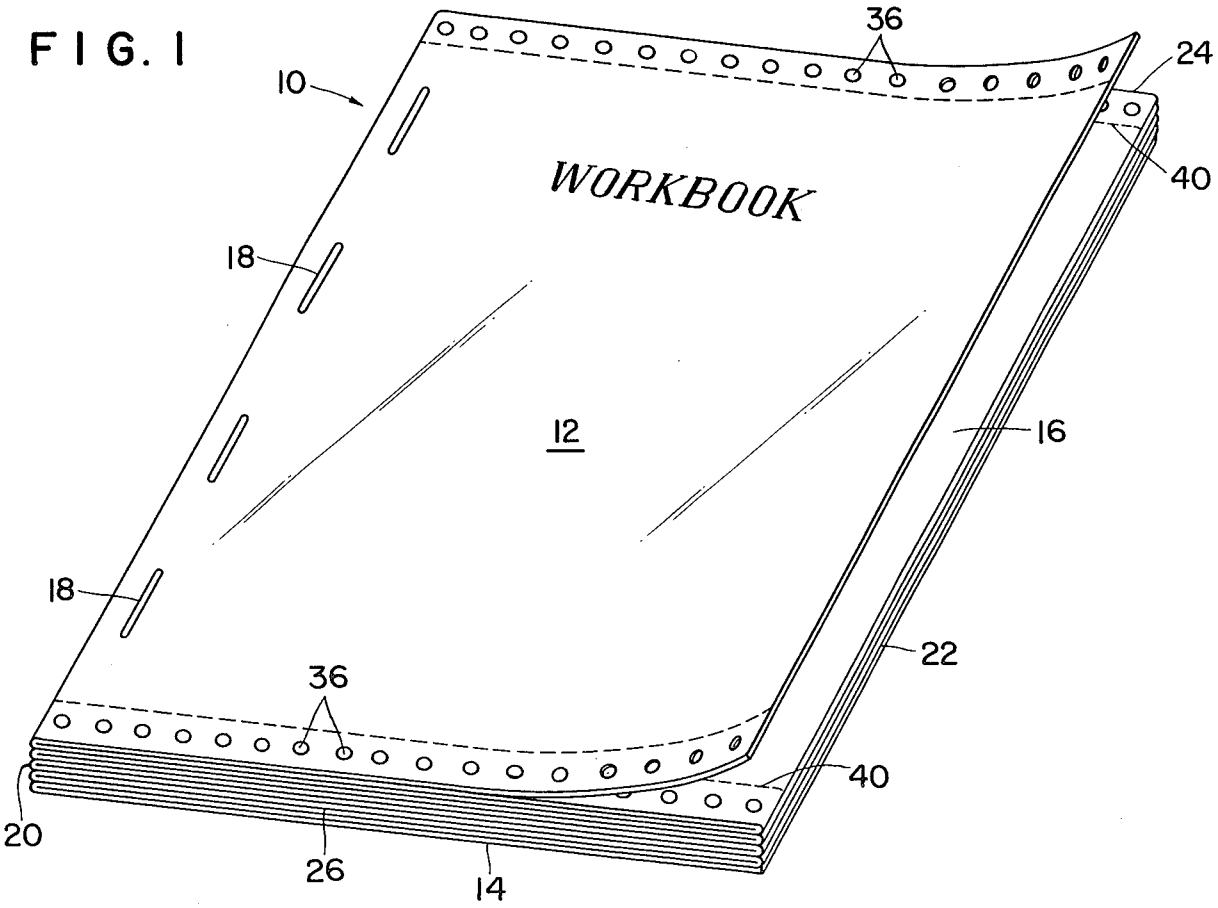
FIG. 1 is a perspective view of a preferred form of the booklet embodying the principles of my invention.

I believe that my invention is best embodied in the booklet 10 of FIG. 1, in which I have shown the covers and leaves of the booklet exaggerated in thickness to expedite illustration and understanding. It will be observed from this figure that the representative booklet 10 is fabricated from a strip of paper in the form of a continuous web of paper which has been folded in zigzag manner to provide a single leaf front cover 12, a single leaf rear cover 14, and a group of leaves 16 between the front and rear covers. All these covers 12 and 14 and leaves 16 are bound together by a row of wire staples 18 along the rear edge or spine 20 of the booklet 10. It will also be noted that every two neighboring ones of the leaves 16 are joined or coupled, or left uncut, at the front edge 22 opposite the rear edge 20 of the booklet 10. In this particular embodiment, moreover, every two joined leaves 16 are further pasted or sealed together along their top and bottom edges 24, 26 extending between the rear edge 20 and front edge 22, as will be better understood as the description proceeds.

Figure 2:
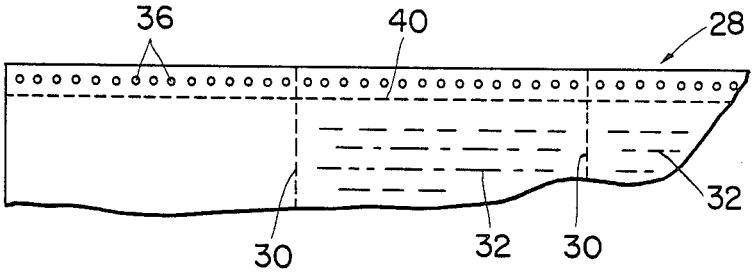
FIG. 2 is a fragmentary plan view showing one side of the continuous web of printed, perforated paper from which the booklet of FIG. 1 is made, the web side shown here forming the outer pages of every two united leaves of the booklet.
Figure 3:
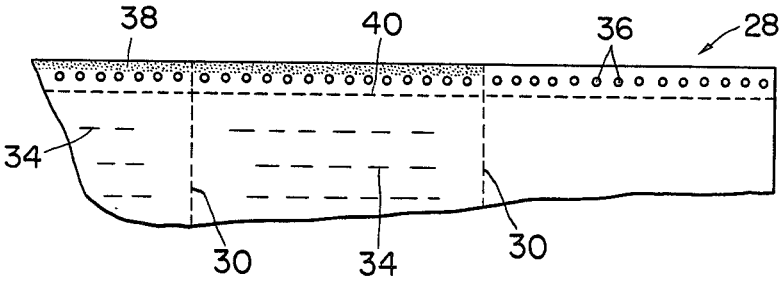
FIG. 3 is a view similar to FIG. 2 but showing the other side of the web.

FIGS. 2 and 3 are illustrations of the opposite sides of the continuous web 28 of paper or any other material from which the booklet 10 is made. The web 28 has therein rows of minute perforations 30 such as those which may be made by a sewing needle. These perforated lines 30 extend transversely of the web 28 at a constant longitudinal interval or spacing thereby marking or forming the boundaries between what are to become the covers 12 and 14 and leaves 16 of the booklet 10.

In the use of the booklet 10 as a workbook, for example, there may be printed questions or problems, perhaps together with other comments and illustrations, on the front side or face of the web 28 seen in FIG. 2 which becomes the pages of the booklet. I have indicated by the reference numeral 32 such printings or printed matter on the front side of the web 28. On the rear side or face of the web 28 seen in FIG. 3 which also becomes the pages of the booklet 10, there may be printed the answers or solutions for the questions or problems together with any other pertinent matter. The reference numeral 34 designates such printings or printed matter on the rear side of the web 28.

Figure 5:
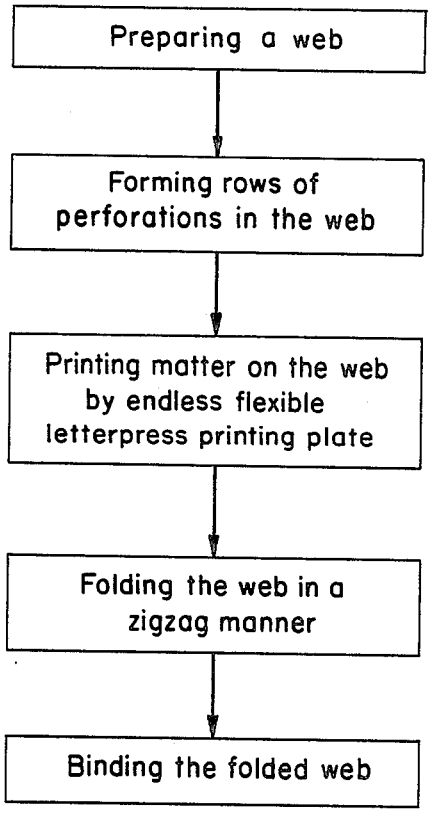
FIG. 5 is a diagram showing the steps of manufacturing a booklet according to the present invention.

As will be seen also from FIG. 1, the web 28 has two rows of sprocket holes 36 extending along the opposite longitudinal edges thereof. These sprocket holes are for engagement with sprocket teeth on an endless flexible letterpress printing plate mounted on a printing press in making the printings 32 and 34 on the web 28. As shown in FIG. 5, I recommend the use of such a printing plate because it makes possible the printing of the complete or whole length of each side of the web 28 at one stretch or in one printing run. Further, preferably, the printing press may be incorporated with bookbinding equipment for the streamlined fabrication of the booklet 10 in accordance with my invention.

Perhaps as an incidental feature of my invention, the web 28 has a pair of continuous adhesive regions or layers 38, one seen in FIG. 3 in the shape of slender strips formed on its rear side only and extending along the opposite longitudinal edges of the web except its end portions which are to become the covers 12 and 14 of the booklet 10. The adhesive regions 38 disposed between every two opposed or confronting pages are used to seal every two opposed pages together in the completed booklet 10. A pair of rows of small perforations 40, one seen in FIGS. 2 and 3 and both shown in FIG. 1, are formed just inwardly of the two rows of sprocket holes 36 and also extend parallel to the longitudinal edges of the web 28. These rows of perforations 40 are intended for use in tearing off the sealed top and bottom edge portions of the leaves 16 of the booklet 10.

Figure 4:
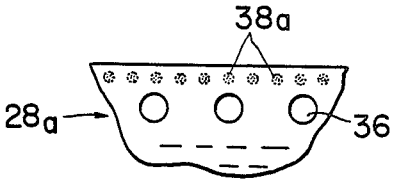
FIG. 4 is an enlarged, fragmentary plan view of an alternative form of the web which can also be processed into the booklet of FIG. 1.

The pair of perforated lines 40 are unessential. In FIG. 4, I have shown an alternative web **28*a* wherein an adhesive layer is provided in the form of a series of isolated spots 38*a* extending along each longitudinal edge of the web and located just outwardly of each row of sprocket holes 36. By sealing two joined leaves 16 together through such isolated adhesive spots 38*a*, any two joined leaves 16 of the booklet 10** will readily come apart without tearing.

As shown in FIG. 5, for the manufacture of the booklet 10 by the method of my invention, the web 28 of FIGS. 2 and 3 (or the web **28*a* of FIG. 4) may be folded alternately in opposite directions along the successive perforated lines 30, by first folding the web end portion 42, which is to become either the front or rear cover 12 or 14 of the booklet 10 in a direction away from the rear side of the web on which the adhesive regions 38 are formed. Then the folds of the web may be bound together along the rear edge 20 by the wire staples 18. Wire stapling is, of course, an example of binding means that is adoptable for holding together the folded web in accordance with my invention. Additional examples include thread stitching or sewing, pasting, and loose leaf binding. As required, pressure may be exerted on the folded web in its thickness direction in order to assure firm sealing of the top and bottom edge portions of every two joined leaves 16 via the adhesive regions 38 (or 38*a*). The fabrication of the booklet 10** has now been completed.

Every two leaves 16 of the thus completed booklet 10 are joined through the fold at the front edge 22. After solving the questions or problems printed on the exposed pages of joined leaves, the student may tear them apart along the perforated line 30 at the front edge 22 of the booklet and along the perforated lines 40 along the top and bottom edges 24 and 26, thereby gaining access to the printed solutions on the hidden or concealed pages. In the case of the FIG. 4 embodiment, the student may tear along the perforated line 30 and then pull the two leaves apart to separate their top and bottom edges that have been sealed by the series of adhesive spots **38*a***.

It is understood that the foregoing detailed disclosure is by way of example only and not to impose limitations on my invention, as a variety of modifications or alterations will readily occur to one skilled in the art of book manufacture. For example, the printed and perforated web may be so folded as to form no front or rear cover but to provide only leaves every neighboring two of which are united, and these leaves may, or may not, be fitted and sealed into a separate cover. As another possible modification of the illustrated embodiment, every two neighboring leaves may not necessarily be sealed together along their top and bottom edges, since the objectives of my invention can be largely accomplished if the leaves are united at the front edge only. Additional modifications and changes may be resorted to without departing from the scope of my invention.

I claim:

1. A booklet particularly suitable for use as a textbook, a manual, or a supplement to other printed publications such as books or magazines, comprising:

(a) a continuous web having printed matter printed on both sides thereof by an endless flexible letterpress printing plate and being folded alternately in opposite directions along predetermined folding lines extending transversely of the continuous web at a constant longitudinal spacing;

(b) means for binding the folded web along a binding edge thereof to define a plurality of pairs of every two neighboring leaves of the booklet, the neighboring leaves being joined together along unbound edges of the folded web opposite the binding edge; and (c) means defining rows of perforations disposed along the predetermined folding lines connecting each two joined leaves of the booklet whereby two joined leaves can be readily torn open along the row of perforations.

2. A booklet as set forth in claim 1; including means for separably sealing two neighboring leaves together along top and bottom edges thereof extending between the binding and unbound edges.

3. A booklet as set forth in claim 2; wherein each leaf has means defining additional rows of perforations extending along top and bottom edges thereof, whereby the sealed top and bottom edges of each two neighboring leaves are separable by tearing the additional rows of perforations.

4. A booklet as set forth in claim 2; wherein the sealing means comprises isolated adhesive spots disposed along the top and bottom edges.

5. A booklet as set forth in claim 1; further including a single leaf front cover composed of a folded end portion of the continuous printed web.

6. A booklet as set forth in claim 5; further including a single leaf rear cover composed of another folded end portion of the continuous printed web.

7. A method of manufacturing a booklet comprising the steps of:

(a) preparing a continuous web containing printing matter on both sides thereof by using an endless flexible letterpress printing plate and forming therein rows of perforations extending transversely thereof at a constant longitudinal spacing;

(b) folding the web along the successive rows of perforations alternately in opposite directions; and (c) binding the folded web along a predetermined binding edge thereof to form a plurality of pairs of neighboring leaves of the booklet, each pair of neighboring leaves being joined together through one row of perforations along unbound edge thereof opposite the binding edges whereby two joined leaves can be readily torn open along the row of perforations.

8. A method of manufacturing a booklet as set forth in claim 7; wherein the prepared web is formed with adhesive layers on one face thereof along opposite longitudinal edges thereof, and each two neighboring leaves are further joined together along top and bottom edges extending between the binding and unbound edges via the adhesive layers.

9. A method of manufacturing a booklet as set forth in claim 8; wherein the prepared web has further formed therein additional rows of perforations extending along the opposite longitudinal edges thereof and arranged inwardly of the adhesive layers, whereby the joined top and bottom edges of each two neighboring leaves are separable by tearing along the additional rows of perforations.

10. A method of manufacturing a booklet as set forth in claim 7; wherein the prepared web is folded so as to form a single leaf front cover.

11. A method of manufacturing a booket as set forth in claim 10; wherein the perpared web is folded so as to form a single leaf rear cover.

12. A method of manufacturing a booklet as set forth in claim 7; wherein the web has rows of sprocket holes extending along the opposite longitudinal edges thereof to facilitate printing of the web.

13. A booklet produced by the method set forth in claim 7.

14. A booklet comprising: a strip of paper folded in a zigzag manner along fold lines extending transversely of the strip at predetermined intervals therealong to define a stack of leaves having front and rear edges along the respective fold lines, the strip containing printed matter printed on both sides of the strip by an endless flexible letterpress printing plate; means binding the stack of leaves along the rear edges thereof to define a plurality of separate pairs of adjacent leaves, the adjacent leaves of each pair being coupled with each other along a fold line at the front edge; and means defining perforations along the fold lines at the front edges to render adjacent coupled leaves readily separable along the perforations.

15. A booklet as set forth in claim 14; including means for separably sealing adjacent coupled leaves along top and bottom edges extending transversely of the front and rear edges for temporarily concealing the printed matter printed on the confronting faces of the adjacent coupled leaves.

16. A booklet as set forth in claim 15; wherein the means for separably sealing comprises adhesive layers disposed between the respective adjacent coupled leaves along the top and bottom edges, and means defining additional perforations disposed inwardly of the adhesive layers on the leaves.

17. A booklet as set forth in claim 15; wherein the means for separably sealing comprises adhesive spots isolated from each other and disposed between the respective adjacent coupled leaves along the top and bottom edges.

18. A booklet as set forth in claim 14; including a single leaf front cover composed of a folded end portion of the strip.

19. A booklet as set forth in claim 18; including a single leaf back cover composed of the other folded end portion of the strip.

20. A method of manufacturing a booklet comprising the steps of: preparing a web having a pair of opposed sides extending lengthwise thereof; forming lines of perforations transversely of the web at predetermined intervals therealong to define a leaf between adjacent lines of perforations; printing matter on both pages of each of the leaves by means of an endless flexible letterpress printing plate so that the printing of each side of the web is carried out in one printing run; folding the web in a zigzag manner along the lines of perforations to form a stack of leaves having front and rear edges along the lines of perforations; and binding the stacked leaves along the rear edges to form a plurality of separate pairs of adjacent leaves, the adjacent leaves of each pair being separably coupled with each other along a line of perforations at the front edge.

21. A method as set forth in claim 20; including the step of sealing adjacent coupled leaves of each pair along top and bottom edges extending transversely of the front and rear edges to conceal the printed matter printed on the confronting pages of the adjacent coupled leaves.

22. A method as set forth in claim 21; including the steps of forming additional lines of perforations along the top and bottom edges.

23. A method as set forth in claim 20; including folding one end portion of the web to form a single leaf front cover of the booklet.

24. A method as set forth in claim 23; including folding the other end portion of the web to form a single leaf back cover of the booklet.

25. A method as set forth in claim 20; wherein the web has a pair of rows of sprocket holes along the opposite longitudinal edges of the web.

26. A method as set forth in claim 25; including using the rows of sprocket holes to guide the web during the printing step.

27. A method as set forth in claim 20; wherein the folding step is carried out downstream of the printing step.

28. A booklet produced by the method set forth in claim 20.

29. A method as set forth in claim 20; wherein the step of printing matter comprises the step of printing different matter on each page of each leaf to constitute a booklet.

* * * * *